US005737789A

United States Patent [19]

Fleissner

[11] Patent Number: 5,737,789

[45] Date of Patent: Apr. 14, 1998

[54] METHOD FOR SIMULTANEOUS APPLICATION OF A MINIMAL QUANTITY OF A PROCESSING FLUID TO A TEXTILE WEB OF GOODS

[75] Inventor: Gerold Fleissner, Zug, Switzerland

[73] Assignee: Fleissner GmbH & Co. Maschinenfabrik, Egelsbach, Germany

[21] Appl. No.: 868,068

[22] Filed: Jun. 3, 1997

Related U.S. Application Data

[62] Division of Ser. No. 562,180, Nov. 22, 1995.

[30] Foreign Application Priority Data

Nov. 24, 1994 [DE] Germany ..... 44 41 805.1

[51] Int. Cl.[6] ..... D06B 1/08

[52] U.S. Cl. ..... 8/151

[58] Field of Search ..... 68/200, 205 R; 118/410, 413, 419; 8/151

[56] References Cited

U.S. PATENT DOCUMENTS 3,418,970 12/1968 Phelps et al. ..... 118/413 X 4,550,681 11/1985 Zimmer et al. ..... 118/410

5,243,841 9/1993 Fleissner ..... 68/205 R

*Primary Examiner*—Philip R. Coe

*Attorney, Agent, or Firm*—Antonelli, Terry, Stout, & Kraus, LLP

[57] ABSTRACT

A device for application of a minimum quantity of fluid to a web of goods of a given width, wherein application takes place by means of an application beam in which the fluid is distributed uniformly over the working width through a plurality of fluid lines that branch in the manner of a tree trunk. The outlet openings of the lines terminate in a slot that is open facing the web, the length of the slot being delimited by two lengthwise edges. These edges press against a pressure roller located on the opposite side, i.e the back of the web. By means of these lengthwise edges, as the web passes though, its nap is compressed twice, once at the beginning of application with a first lengthwise edge, after which the nap stands up again in the slot and is saturated with the fluid, and again at the end of the application, after which the web is finally squeezed against the second lengthwise edge.

1 Claim, 2 Drawing Sheets

METHOD FOR SIMULTANEOUS APPLICATION OF A MINIMAL QUANTITY OF A PROCESSING FLUID TO A TEXTILE WEB OF GOODS

This application is a Divisional application of application Ser. No. 08/562,180, filed Nov. 22, 1995.

BACKGROUND OF THE INVENTION

This invention relates to a method for uniform application of a minimal quantity of a processing or finishing fluid to a textile web of goods of a certain width as the web passes by, with an application beam aligned crosswise to the web, said beam having an open slot extending across the width of the web and directed against the latter, to which slot the fluid as liquid is supplied uniformly over the working width of the web, and with a support for the web located opposite the slot on the other side of the web.

A device of this type of application is known from DE 33 15 770 A1. The support consists of an elastically flexible closed cushion which covers the slot and a larger area located laterally next to the slot to apply the fluid emerging from the slot to the web without loss.

In addition to this type of application device, apart from liquid pouring devices, only screen printing devices are known in which the support can consist of a horizontal screen, possibly with suction, or a dense endless belt, or of a roller that carries the web past the slot. DE 34 19 367 A1 may be mentioned in this regard for example. The important aspect of screen printing machines, however, is that the slot is surrounded by a rotating screen cylinder through whose perforations the fluid is forced to create a pattern. The present invention, however, does not relate to such devices; rather, in accordance with the present invention, a device is to be provided with which a minimum quantity of fluid can be applied uniformly over the working width of the web and pressed optimally into a surface like a nap of a textile, specifically to saturate completely only the surface of the web.

SUMMARY OF THE INVENTION

Taking its departure from the device of the type heretofore described, the goal of the invention consists in providing a device with which the minimum quantity of fluid required for sufficient wetting is not only distributed uniformly over the working width but also penetrates into the fiber surface of the web as well as the nap or the like.

To achieve the stated goal, the invention provides that the support be in the form of a pressure roller aligned parallel to an application beam, said roller being pressed against two lengthwise edges delimiting the slot by the web passing therebetween. The reason for this design is the desirable production of the nap after compression by the pressure of the roller, so that the fibers absorb the necessary amount of fluid down to their roots, and the web is squeezed gain immediately thereafter to reduce the amount of fluid to only the minimum amount necessary. These three processes—compression, breathing, and compression again of the nap—are arranged in a direct sequence in the device according to the invention so that the desired economical minimum amount of fluid is applied and minimum consumption is ensured.

The spacing of the lengthwise edges of the slot depends on the nature and volume of the goods to be processed. In any event, the surface of the web after being pressed against the roller should stand up and breath again, so it can absorb the fluid and then be squeezed again, leaving only the amount of fluid that is actually required in the nap. The aim is to make the spacing of the lengthwise edges of the slot on the order of twice the length of the respective nap of the web. The slot may be wider, however, under certain circumstances.

The uniform feed of the processing fluid within and across the width of the slot is also important. A good solution is provided by DE 40 26 198 A1. For this reason, it is also proposed in the device according to the invention that the slot be connected to a fluid distribution device in which the fluid is distributed in stages from a feed line to a plurality of outlet openings so that the feed opening is connected on both sides in the direction of the working width with a first branched line of the same length at whose end an intermediate outlet opening is provided, to which, in the same fashion and on both sides in the working width direction, a second branch line connects that is shorter by half than the first branch line and has a reduced cross section, in other words the fluid distribution in this device divides several times like the trunk of a tree, so that the outlet openings finely distributed over the working width terminate in the slot that extends over the working width of the web.

BRIEF DESCRIPTION OF THE DRAWINGS

The accompanying drawings show an embodiment of the device according to the invention as an example, wherein.

Additional inventive details of the device will now be described with reference to this example.

DETAILED DESCRIPTION OF THE INVENTION

Figure 1:
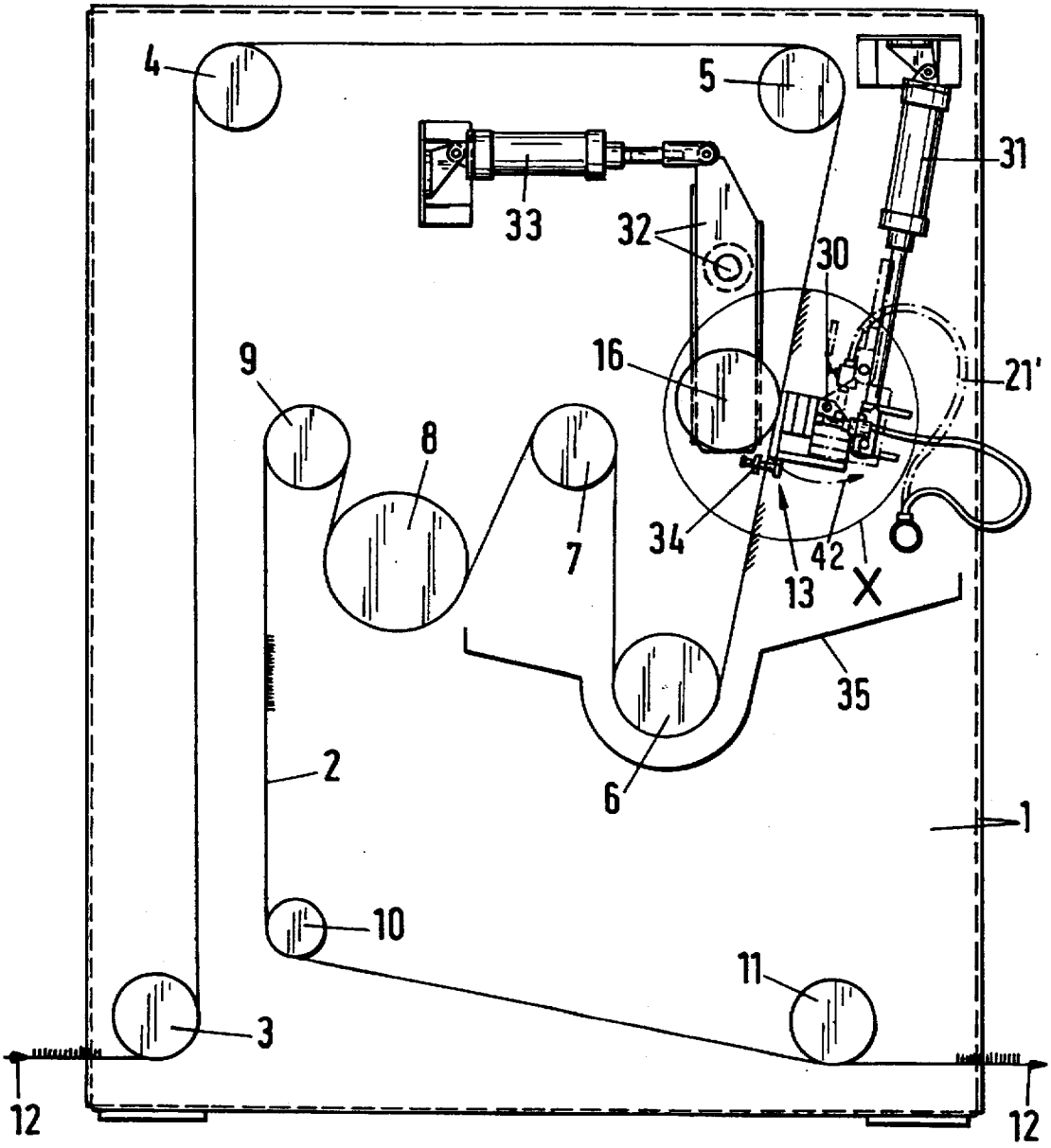
FIG. 1 is a schematic side view of the fluid application device.
Figure 2:
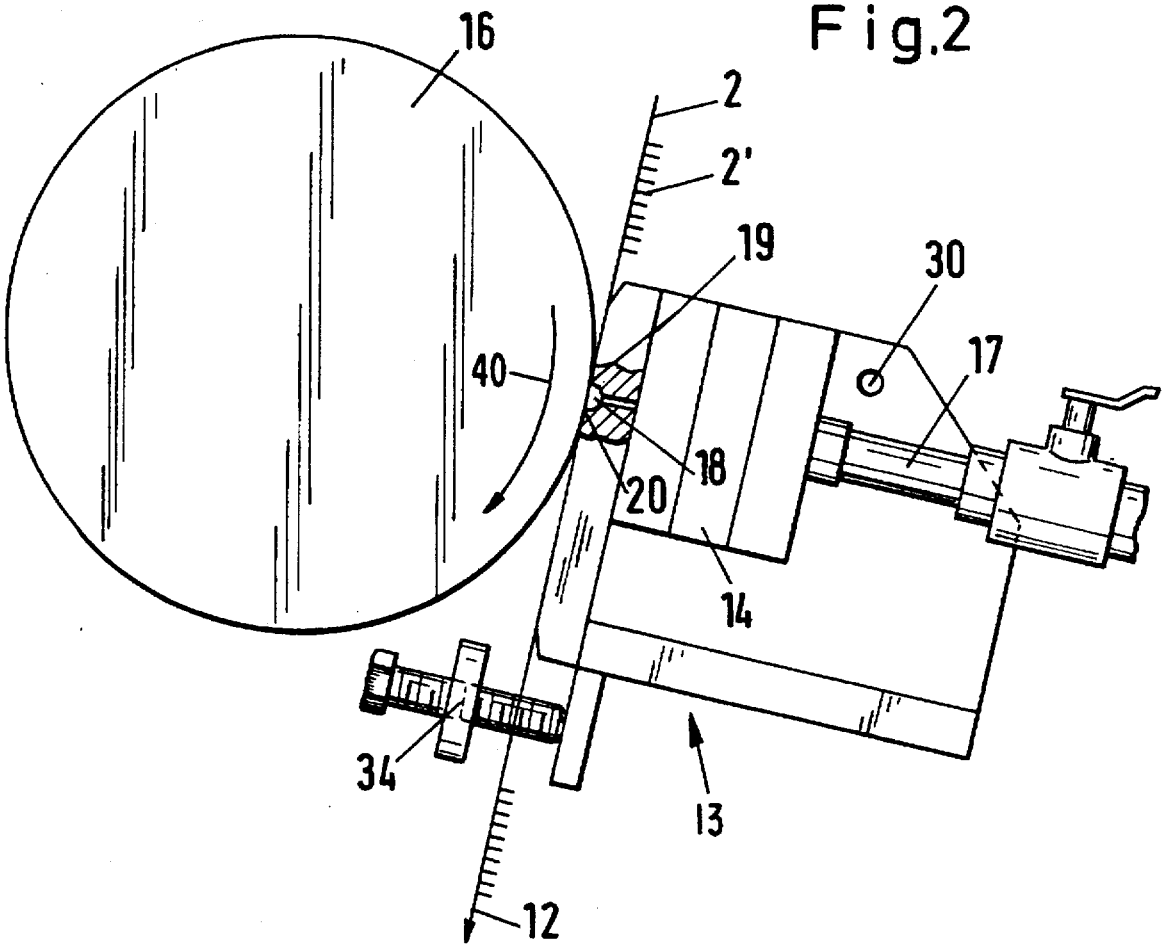
FIG. 2 is an enlarged schematic view which shows detail x (in area encircled in FIG. 1) of the application device in greater detail.

The fluid application device according to FIG. 1 consists of a vertical frame 1 on which a series of either guiding or reversing rollers 3–11 is rotatably mounted to guide web 2 to the respective processing station. The direction of travel of the web is indicated by arrow 12. From reversing roller 5 supported in frame 1, web 2 runs diagonally backward and downward to a reversing roller 6. The web, with the nap facing toward the right between rollers 5 and 6 in FIG. 1, therefore, has a downward slope, which will be described in greater detail below. Application device 13 is provided roughly in the center between rollers 5 and 6. Likewise according to FIG. 2, the application device consists of an application beam 14 located in the nap side of web 2, with fluid distribution device 15 shown in FIG. 3, as well as a pressure roller 16 located on the back of web 2, said pressure roller being located centrally with respect to application beam 14. Application beam 14 and pressure roller 16 are aligned with their effective longitudinal axes perpendicular to web 2, and are, therefore, likewise inclined backward. The axis line of application beam 14 is designated by 17 in FIG. 2.

Application beam 14, on the side facing the web, has a slot 18 through which the application fluid is pressed or forced into web 2. On the outlet side, the slot has two lengthwise edges 19, 20 that extend over the working width of application beam 14. The height of slot 18 according to the embodiment results from the design being semicircular in cross section. Pressure roller 16, which is arranged centrally with respect to slot 18 on the other side of web 2 and rotated in the direction of arrow 40, abuts lengthwise edges 19, 20 of slot 18. In this manner nap 2' of web 2 is initially compressed on the long edge 19, with the air being forced out of the web as it passes through application device 13, and the web is then wetted with the respective application fluid in slot 18 after or during alignment, and is then pressed against lengthwise edge 20 so that only a minimum amount of fluid necessary remains in nap 2'.

Figure 3:
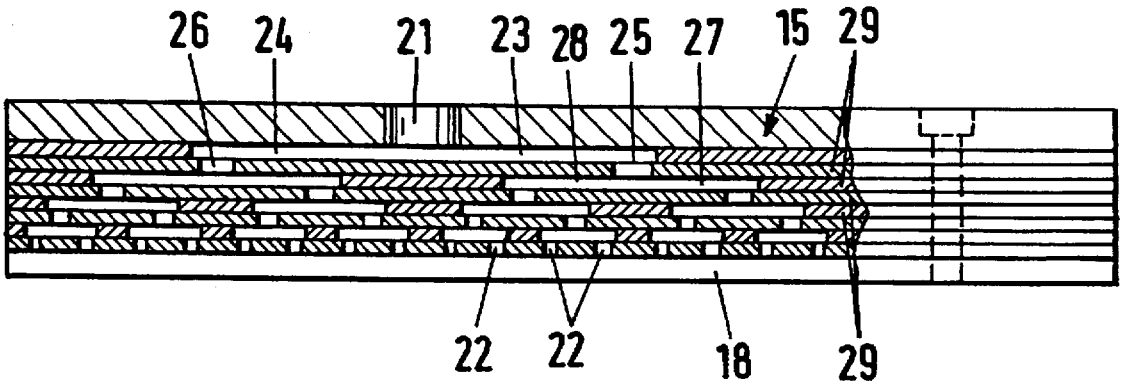
FIG. 3 shows a cross sectional view through the application beam of the fluid distributing device.

In order for the fluid to be applied to web 2 to be distributed uniformly over the working width in slot 18, a distributing device 15 is provided in application beam 14 as shown in FIG. 3. The fluid is distributed from a feed line 21 connected by a hose 21' to supply the fluid to a plurality of outlet openings 22 in stages in such fashion that supply opening 21 is connected on both sides in the direction of the working width with a first branch line 23, 24 of the same length, at whose respective ends intermediate outflow openings 25, 26 are provided which second branch line 27, 28 abuts, said lines being shorter by half than first branch lines 23, 24 and reduced in cross section, and provided in similar fashion on both sides in the direction of the working width. The fluid distribution, therefore, branches in this fluid distribution device in the manner of a tree trunk. Outflow openings 22 finely distributed over the working width terminate in slot 18 that extends over the working width of web 2. The individual lines and openings 21, 28 in distribution device 15 are formed in sheets of metal 29 that are simply pressed against one another to seal the lines.

Application beam 14 is pivotable in the direction of the arrow 42 around axis 30 by means of pressure cylinder 31 mounted on frame 1 so that slot 18 can be directed downward and cleaned, for example. For the same purpose, pressure roller 16 is mounted in holder 32 with pressure cylinder 33 in frame 1 so that it can be swung away from application beam 14. This device can also be used to adjust the position of pressure roller 16 relative to slot 18. At the same time, the distance of application beam 14 from web 2, for example, can be adjusted by means of device 34. Below application device 13 a fluid collecting trough 35 extends horizontally on the frame 1, said trough surrounding return roller 6 and collecting drippings or wiped-off fluid there to be recycled by means not shown.

What is claimed is:

1. A method for uniform application of a minimum quantity of a processing or finishing fluid to a passing textile web of goods of a given width, comprising passing said web between a pressure roller and an application beam arranged transversely with respect to the web and parallel to the pressure roller, said application beam having an open slot extending over the width of the web and facing said web; uniformly supplying fluid to the slot over the working width of the web; and pressing the web passing between the roller and the application beam against lengthwise edges that delimit the slot; the lengthwise edges of the slot being arranged with a vertical space therebetween and a surface of the web to be treated including a nap being compressed between the pressure roller and each of the lengthwise edges, wherein the vertical space is sized and the pessure roller arranged with respect to the vertical space so that the web is initially compressed between the pressure roller and one lengthwise edge, then allowed to breath and receive the fluid in the slot located between the lengthwise edges when freed of the pressure of the pressure roller, and again compressed between the pressure roller and another lengthwise edge so that only a minimal amount of the fluid remains in the nap.

* * * * *